United States Patent [19]

Baur

[11] Patent Number: 4,488,979

[45] Date of Patent: Dec. 18, 1984

[54] HYDRAULIC FLUID

[75] Inventor: Rudolf Baur, Kreuzlingen, Switzerland

[73] Assignee: Swiss Aluminium Ltd., Chippis, Switzerland

[21] Appl. No.: 464,326

[22] Filed: Feb. 7, 1983

[30] Foreign Application Priority Data

Feb. 23, 1982 [CH] Switzerland ..... 1091/82

[51] Int. Cl.[3] ..... C10M 3/12; C10M 3/16

[52] U.S. Cl. ..... 252/79; 252/56 R; 252/73; 585/3; 585/10

[58] Field of Search ..... 252/56 R, 73, 79; 585/3, 10

[56] References Cited

U.S. PATENT DOCUMENTS

| | | | |
|---|---|---|---|
| 2,366,794 | 1/1945 | Lamb | 252/73 |
| 2,899,390 | 8/1959 | Plemich | 252/56 R |
| 2,962,401 | 11/1960 | Guminski | 252/56 R |
| 3,283,029 | 11/1966 | Brilland et al. | 252/73 |
| 3,298,951 | 1/1967 | Guminski | 252/56 R |

*Primary Examiner*—Paul Lieberman
*Assistant Examiner*—Robert A. Wax
*Attorney, Agent, or Firm*—Bachman and LaPointe

[57] ABSTRACT

A hydraulic fluid which contains 100 parts by weight of polyisobutylene, 3 to 15 parts by weight of butylstearate and 0.5 to 5 parts by weight of palm seed oil. It shows good compatibility with newly rolled aluminum surfaces and is therefore particularly suitable for feeding hydrostatic means of supporting rolls for roll-forming aluminum and aluminum alloys.

8 Claims, No Drawings

HYDRAULIC FLUID

BACKGROUND OF THE INVENTION

The invention concerns a hydraulic fluid, in particular for feeding hydrostatic means of support for rolls used for roll-forming aluminum and aluminum alloys.

Rolls with hydrostatic means of support in the interior of the rotating roll shells are such that the hydraulic fluid has to be fed to the said means of support. The inflowing film of hydrostatic fluid between the means of support and the inner face of the roll shells transmits the rolling force and conducts away the heat produced in the deformation process.

The tribo-physical properties required of a hydraulic fluid can be produced by using commercially available products having the characteristics prescribed by the manufacturer of the rolling mill. When rolling aluminum down to foil, however, in spite of all precautions it must be expected that some hydraulic fluid will enter the foil rolling lubricant. Even a relatively small degree of contamination of the rolling lubricant with hydraulic fluid markedly lowers the surface quality of the resultant aluminum foil. Leakage, i.e. of hydraulic fluid into the rolling lubricant, can on subsequent degrease annealing, lead to the following problems with coiled and re-coiled foil: stickiness of the foil strip, non-uniform degreasing of the foil surface, dark colored areas after annealing, white colored spots due to corrosion and contaminated foil surfaces. Residual, thermolytically altered traces of hydraulic fluid left on the surface of the aluminum foil after degreasing in an oxygen containing atmosphere can be detrimental to the properties of the aluminum foil. For example, if such contaminated aluminum foils are employed for impregnated physical capacitors, both the loss angle (tan $\delta$) of the spool and the aging behavior are negatively affected. Traces of hydraulic fluid also have detrimental effects on aluminum foils which are chemically or electrochemically etched after annealing and are used for making electrolytic capacitors.

In view of the above it is an object of the invention to develop a hydraulic fluid, which is suitable for feeding to hydrostatic means of support for the rolls and which, when used in roll-forming aluminum, does not lead to any undesirable changes in the aluminum surface, if it enters the rolling lubricant.

SUMMARY OF THE INVENTION

This object is achieved by way of the invention in that the fluid contains 100 parts by weight of polyisobutylene, 3–15 parts by weight of butylstearate and 0.5–5 parts by weight of palm seed oil.

DETAILED DESCRIPTION

Polyisobutylene serves as the basis and provides the tribophysical properties. Butylstearate is added as a lubricant. Palm seed oil acts as a rust inhibitor and, as reaction layer former, also improves the lubricating properties of the hydraulic fluid under extreme pressure conditions. All components of this fluid can be removed from aluminum surfaces without problem by a degreasing anneal.

To arrive at the desired kinematic viscosity, polyisobutylene is preferably added as a mixture of a first polyisobutylene with an average molecular weight of about 460 and a second polyisobutylene with an average molecular weight of about 320. The weight ratio of the first polyisobutylene to the second is preferably 1:9 to 1:1, in particular 1:4 to 1:1.5.

The amount of butylstearate is preferably between 5 and 10 parts by weight.

The hydraulic fluid contains preferably 1 to 3 parts by weight of palm seed oil, whereby its concentration of free fatty acids should, for reasons of corrosion, at most be 0.2 wt.%.

In order to reduce the danger of the hydraulic fluid having a corrosive action, care should also be taken to ensure that the fluid is essentially free of traces of water.

The following composition of hydraulic fluid according to the invention has shown itself to be particularly suitable for feeding to the means of support for the roll shells of backing rolls used for roll-forming aluminum strip to foil, and this both with respect to its tribo-physical properties and its compatibility with newly rolled aluminum surfaces:

30 parts by weight of polyisobutylene MW 460,
70 parts by weight of polyisobutylene MW 320,
7 parts by weight of butylstearate,
2 parts by weight of palm seed oil.

The kinematic viscosity of this composition is 270 cSt at 20° C., 52 cSt at 50° C. and 34 cSt at 60° C. It is particularly suitable for long term usage in the temperature range 30° to 60° C.

What is claimed is:

1. A hydraulic fluid characterized by good compatibility with rolled aluminum surfaces containing 100 parts by weight of polyisobutylene, 3 to 15 parts by weight of butylstearate and 0.5 to 5 parts by weight of palm seed oil, wherein said polyisobutylene is a mixture of polyisobutylenes with all components having an average molecular weight of about 320 and above.

2. Hydraulic fluid according to claim 1 wherein the said fluid contains a mixture of polyisobutylenes, the first having an average molecular weight of about 460 and the second an average molecular weight of about 320.

3. Hydraulic fluid according to claim 2 wherein the weight ratio of the first polyisobutylene to the second polyisobutylene is 1:9 to 1:1.

4. Hydraulic fluid according to claim 2 wherein the weight ratio of the first polyisobutylene to the second polyisobutylene is 1:4 to 1:1.5.

5. Hydraulic fluid according to claim 1 wherein the butylstearate concentration is 5 to 10 parts by weight.

6. Hydraulic fluid according to claim 1 wherein the palm seed oil concentration is 1 to 3 parts by weight.

7. Hydraulic fluid according to claim 6 wherein the concentration of free fatty acids in the palm seed oil is at most 0.2 wt. %.

8. Hydraulic fluid according to claim 1 wherein the said fluid is essentially free of traces of water.

* * * * *